US012352553B1

(12) United States Patent
Phelps et al.

(10) Patent No.: US 12,352,553 B1
(45) Date of Patent: Jul. 8, 2025

(54) REMOTE FIRING SYSTEM

(71) Applicant: The United States of America as Represented by the Secretary of the Navy, Indian Head, MD (US)

(72) Inventors: Kevin L. Phelps, Alexandria, VA (US); Brian Amato, Fairfax, VA (US); Daniel Pines, Alexandria, VA (US); Taylor Young, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 220 days.

(21) Appl. No.: 18/445,209

(22) Filed: May 30, 2023

(51) Int. Cl.
*F42D 1/055* (2006.01)

(52) U.S. Cl.
CPC ..... *F42D 1/055* (2013.01)

(58) Field of Classification Search
CPC . F42D 1/04; F42D 1/042; F42D 1/045; F42D 1/05; F42D 1/055; F42D 1/06
USPC ..... 102/200
See application file for complete search history.

(56) References Cited

U.S. PATENT DOCUMENTS 4,884,506 A * 12/1989 Guerreri ..... F42D 1/055 102/202.1
6,860,206 B1 3/2005 Rudakevych
7,966,598 B2 6/2011 Polomik
8,474,379 B2 7/2013 Jacobson
11,156,463 B2 10/2021 Korneluk
2007/0125530 A1* 6/2007 Lerche ..... E21B 41/00 166/55.1
2009/0193993 A1* 8/2009 Hummel ..... F42D 1/055 901/50
2010/0005994 A1* 1/2010 Jacobson ..... F42B 1/02 102/215
2012/0192744 A1 8/2012 Ballantine
2016/0218863 A1* 7/2016 Schlenter ..... H04L 9/0894
2018/0306564 A1* 10/2018 Dinn ..... H04B 5/24

FOREIGN PATENT DOCUMENTS

WO 0159401 8/2001

* cited by examiner

*Primary Examiner* — Troy Chambers
*Assistant Examiner* — Benjamin S Gomberg
(74) *Attorney, Agent, or Firm* — Fredric J. Limmerman

(57) ABSTRACT

A remote firing system for remotely detonating an explosive charge includes a smart controller that utilizes a unique encryption key to generate encrypted command and control messages. The messages include a detonation precondition that must occur before detonation. A bridge transceiver communicates with the smart controller and receives the encrypted messages generated from the smart controller. The bridge transceiver transmits RF signals containing the encrypted messages. At least one remote communicator is in communication with the bridge transceiver and configured to be connected to the explosive charge. The remote communicator receives the RF signals transmitted by the bridge transceiver, processes these received RF signals to obtain the encrypted messages and decrypts the encrypted messages with the encryption key to extract the detonation precondition. The remote communicator generates a trigger signal that causes detonation of the explosive charge upon fulfillment of the detonation precondition.

6 Claims, 10 Drawing Sheets

REMOTE FIRING SYSTEM

STATEMENT OF GOVERNMENT INTEREST

The invention described herein may be manufactured and used by or for the Government of the United States of America for governmental purposes without the payment of any royalties.

CROSS REFERENCE TO OTHER PATENT APPLICATIONS

None

FIELD OF THE INVENTION

The present disclosure is directed to a remote firing system for the firing of weapon systems, and the detonation of ordnance or other explosive devices.

BACKGROUND

Conventional remote firing devices are typically not configured to be hand-held and do not provide any type of real-time information that increases the situational awareness of the operator or user. Conventional remote firing devices are also not easily transported. Many conventional remote firing devices utilize a transmitter and receiver arranged in a paired relationship and which remain relatively static during set-up and testing and do not provide any type of real-time information to improve, enhance or increase the situational awareness of the operators of the remote firing device.

What is needed is a new remote firing system that is relatively smaller, inexpensive and more easily transportable and which provides operators with greater control and security while also allowing the flexibility of on-the-fly programming by the operator.

SUMMARY

A summary of certain exemplary embodiments disclosed herein is set forth below. It should be understood that these aspects are presented merely to provide the reader with a brief summary of these certain exemplary embodiments and these aspects are not intended to limit the scope of this disclosure or the claimed subject matter. Indeed, this disclosure may encompass a variety of aspects that may not be set forth below.

Disclosed herein are exemplary embodiments of a remote firing system. In some embodiments disclosed herein, the remote firing system is configured as a modular system that provides encrypted two-way command, control, and monitoring between a smart controller and one or more remote communicators located downrange. Each remote communicator is paired with the smart controller. The remote communicators may be configured as receivers or transceivers. Each remote communicator comprises an antenna, radio-frequency (RF) circuitry, GPS circuitry, sensors, one or more processors, one or more memory medium and a detonator circuit. The detonator circuit is paired with an explosive charge, energetic or other explosive device. A bridge transceiver is in signal communication with the smart controller and the remote communicators. The smart controller communicates with the remote communicators only through the bridge transceiver. The smart controller and bridge transceiver communicate with each other via encrypted or encoded signals. The smart controller may be any suitable smart communication device including, but not limited to, smart phone, tablet, notepad or notebook computer. The smart controller includes a display, such as a touch screen, that functions as a user interface and which displays information received from the remote communicators. The processor of the smart controller is configured with one or more algorithms on a collaborative mapping software platform that allows command, control, and monitoring of the downrange remote communicators. The operator or user may use the smart device to select from a plurality of detonation preconditions, wherein each detonation precondition defines a precondition that must be fulfilled first before detonation of the explosive charge may occur. Such preconditions include, but are not limited to, elapsed time, motion, noise and vibration levels, temperature and altitude. The selected detonation precondition is selected and encrypted and then routed to the bridge transceiver. The bridge transceiver then transmits an RF signal containing the encrypted detonation precondition to the remote communicator. The remote communicator receives and processes the RF signal to extract the encrypted detonation precondition. The remote communicator then decrypts the encrypted detonation precondition and stores it in a memory medium wherein it is used by a processor of the remote communicator to generate a detonation signal when the detonation preconditions are fulfilled. The detonation signal causes detonation of the explosive charge attached or connected to the remote communicator. The integration of the operator's ability to use the collaborative mapping software on the smart controller to interact, virtually, with the bridge transceiver and remote communicators allows for a number of benefits. The benefits include greater control and real-time monitoring of the remote communicators as well as the corresponding explosive charge and the location or environment in which the remote communicator and explosive charge are located. Such real-time monitoring provides the operator with real-time information relating to the status of the remote communicator, the location of the explosive charge, the presence of military personnel or non-combatants, and the presence of a desired target. In some embodiments, each remote communicator includes a camera and corresponding electronic circuitry that transmits visual data to the bridge transceiver. The bridge transceiver routes this visual data to the smart controller where it is displayed on the display of the smart controller. The smart controller, bridge transceiver and remote communicator provide the operator with the ability to manage detonation authorization through hands-off wireless encryption. The bridge transceiver and remote communicators are configured to communicate in any one of a variety of communication modes including, but not limited to, short-range communication, line-of-sight (LOS) communication, long-range communication, satellite communication and cellular networks. The bridge transceiver and remote communicators are also configured to use ISM (Industrial, Scientific and Medical) radio bands.

The memory medium of the smart controller stores a plurality of different encryption keys. Each encryption key is unique corresponds to a particular downrange remote communicator. The unique encryption key of a remote communicator is also stored in the memory medium of the remote communicator. When the operator desires to communicate with a particular remote communicator, the smart controller encrypts the messages with the unique encryption key that corresponds to that particular remote communicator. Since the bridge transceiver is transmitting RF signals containing the encrypted messages, all of the remote communicators will receive these RF signals and will attempt to decrypt these messages. However, successful decryption will only occur in the remote communicator that has the unique encryption key that was used by the smart controller when encrypting the original message. The unique encryption keys provide enhances the security of the remote firing system in the event one of the remote communicators is compromised.

In one exemplary embodiment, each remote communicator does not contain and is not paired with explosive charges or energetics but instead, utilizes only sensors. In such an embodiment, the sensors may be inert sensors, proprioceptive sensors or exteroceptive sensors. The bridge transceiver is in communication with the sensors and receives signals from the sensors that contains status information pertaining to the environment in which the sensors are located. The sensors may sense a variety of parameters including, but not limited to, motion, vibrations, noise and temperature. The bridge transceiver processes the signals received from the sensors and then routes the processed signals to the smart controller for presentation to the operator. In other embodiments, the remote communicator utilizes a plurality of remote communicators wherein some remote communicators contain and/or are connected to explosive charges or energetics and some remote communicators have only sensors and do not contain and are not paired with any explosive charges or energetics.

In some embodiments, the remote firing system for remotely detonating an explosive charge comprises a smart controller that comprises a display, a memory medium and a programmable processor in communication with the display and memory medium. In some embodiments, the display is a touch screen that also functions as a user interface. The smart controller is configured to generate encrypted command-and-control messages using a unique encryption key. The command-and-control messages include a detonation precondition that defines a precondition that must be fulfilled before the explosive charge may be detonated. The remote firing system further comprises a bridge transceiver that is in communication with the smart controller and includes a memory medium and a processor in communication with the memory medium. The bridge transceiver is configured to receive encrypted command-and-control messages and transmit RF signals containing the encrypted command-and-control messages. The remote firing system further comprises at least one remote communicator that is configured for connection to the explosive charge. The remote communicator is in signal communication with the bridge transceiver and includes a memory medium and programmable processor in communication with the memory medium. The remote communicator is configured to receive the RF signals transmitted by the bridge transceiver, process these RF signals to obtain the encrypted command-and-control messages and then decrypt the encrypted command-and-control messages with the unique encryption key to obtain the detonation precondition. The processor of the remote communicator is configured to generate a trigger signal that causes detonation of the explosive charge upon fulfillment of the detonation precondition.

In some embodiments, the remote firing system comprises a smart controller having a user interface, a memory medium and a programmable processor in data communication with the display and memory medium. The memory medium is configured to store a plurality of different encryption keys and the processor is configured to encrypt command-and-control messages with any of the encryption keys. The command-and-control messages include a detonation precondition that must be fulfilled before detonation of the explosive charge may occur. The remote firing system further includes a bridge transceiver in communication with the smart controller and having a memory medium and a processor in communication with the memory medium. The bridge transceiver is configured to receive the encrypted command-and-control messages from the smart controller and then transmit RF signals containing the encrypted command-and-control messages. The remote firing system further includes a plurality of remote communicators in signal communication with the bridge transceiver. Each remote communicator is configured for connection to a corresponding explosive charge and comprises a memory medium and programmable processor in data communication with the memory medium. Each remote communicator has its own unique encryption key stored in the memory medium of the remote communicator. Each remote communicator is configured to receive the RF signals transmitted by the bridge transceiver, process the received RF signals to extract the encrypted command-and-control message. If the encrypted command-and-control message was encrypted with the same encryption key that is stored in the memory medium of the remote communicator, then that remote communicator is the intended recipient of the message and hence, will be able to successfully decrypt the encrypted command-and-control message to extract the detonation precondition. The processor of the remote communicator is further configured to generate a trigger signal upon fulfillment of the detonation precondition. Each remote communicator further comprises a detonator circuit configured to receive the trigger signal and in response, detonate the explosive charge.

DETAILED DESCRIPTION

As used herein, the terms “comprise”, “comprising”, “comprises”, “includes”, “including”, “has”, “having” or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

Approximating language, as used herein throughout the specification and claims, may be applied to modify any quantitative representation that could permissibly vary without resulting in a change in the basic function to which it is related. Accordingly, a value modified by a term such as "about" or "approximately" is not limited to the precise value specified.

Reference in the specification to "an exemplary embodiment", "one embodiment," "an embodiment" or "some embodiments", means that a particular feature, structure or characteristic described in connection with the embodiment is included in at least one embodiment of the invention. The appearances of the phrases "an exemplary embodiment", "one embodiment", "embodiment" or "some embodiments" in various places in the specification are not necessarily all referring to the same embodiment.

Figure 1:
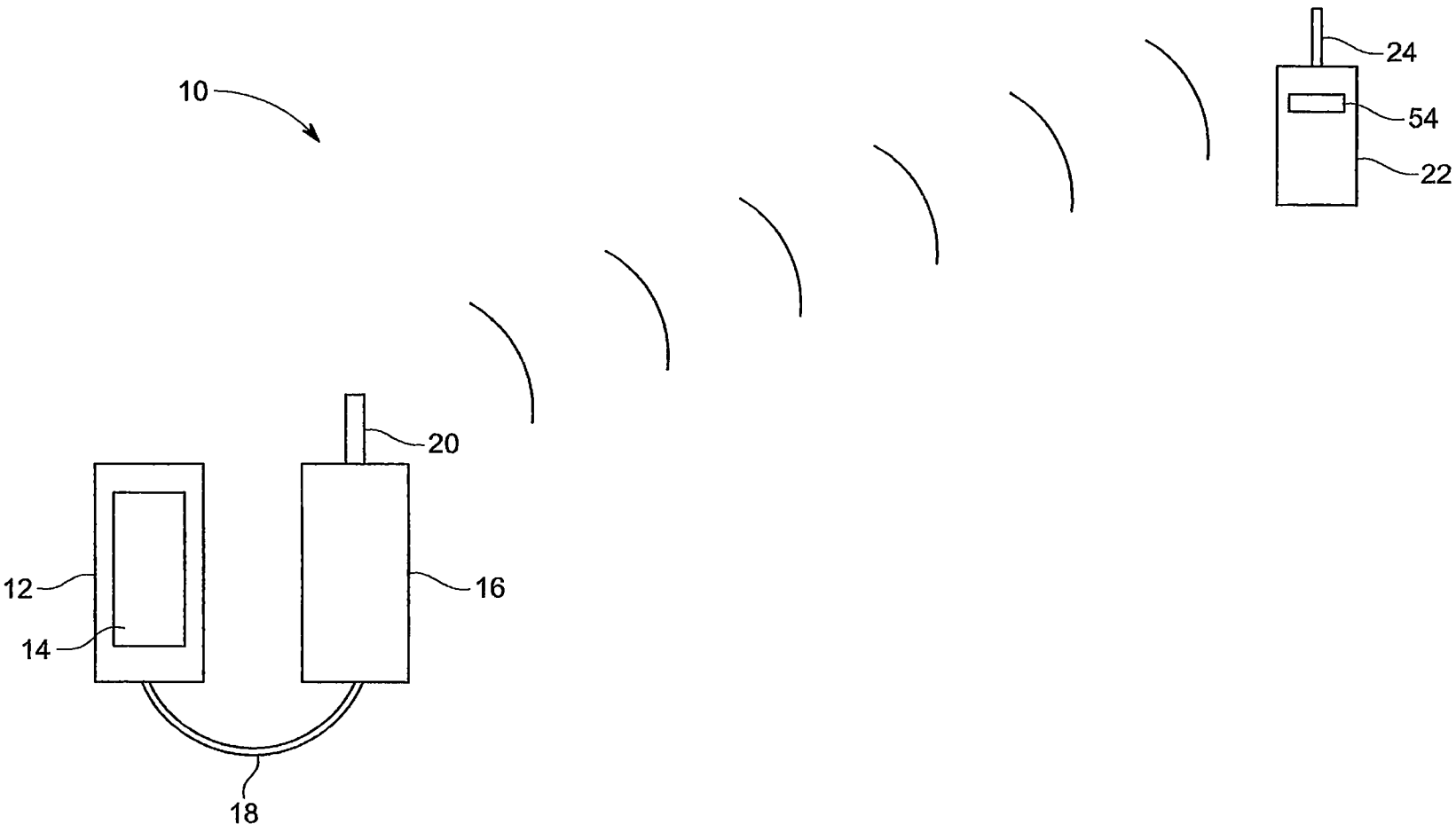
FIG. 1 illustrates a remote firing system in accordance with an exemplary embodiment.

Referring to FIG. 1, there is shown remote firing system 10 in accordance with an exemplary embodiment of the present disclosure. Remote firing system 10 includes smart controller 12 that may be configured as a smart phone, tablet, notepad or similar smart communication device. Smart controller 12 includes display screen 14 that provides real-time visual data. In some embodiments, display screen 14 is a touch screen that also functions as a user interface. These features are discussed in detail in the ensuing description. Remote firing system 10 further comprises bridge transceiver 16 that is in signal communication with smart controller 12. Smart controller 12 and bridge transceiver 16 are sized so that both devices may be carried by an operator or user. Signal communication between smart controller 12 and bridge transceiver 16 may be realized via hardware connection such as USB cable 18. A hardwire connection is a desirable option in radio frequency (RF) signal denied or sensitive environments. Signal communication between smart controller 12 and bridge transceiver 16 may also be realized via wireless signal communication via Bluetooth or Bluetooth Low Energy (BLE). Bridge transceiver 16 comprises circuitry that allows bridge transceiver 16 to transmit and receive signals via antenna 20. Remote firing system 10 further includes at least one downrange remote communicator 22 that is in signal communication with bridge transceiver 16. Specifically, remote communicator 22 includes antenna 24 that receives signals from bridge transceiver 16. In some embodiments, remote communicator 22 includes a transceiver and is configured to receive signals, transmit signals and relay transmissions to other remote communicators 22. In other embodiments, remote communicator 22 is configured as a receiver. In some embodiments, remote communicator 22 is connected to an explosive device, such as an explosive charge (e.g., C4 charge). Smart controller 12, bridge transceiver 16 and remote communicator 22 have electronic circuitry and processing capability to generate, transmit and receive encrypted or encoded signals. Embodiments of smart controller 12, bridge transceiver 16 and remote communicator 22 are described in detail in the ensuing description.

In order to establish signal communication between smart controller 12 and remote communicator 22, bridge transceiver 12 initiates a "pairing" or "handshaking" process that pairs smart controller 12 with remote communicator 22. The pairing or handshaking process is the initial step in establishing signal communication between smart controller 12 and remote communicator 22. Remote communicator 22 must be paired with smart controller 12 in order for smart controller 12 to be capable of controlling remote communicator 22. In some embodiments, remote firing system 10 employs the AES-256 encryption scheme for encrypting and decrypting messages. The AES-256 encryption scheme is a symmetric encryption scheme that uses the same encryption key to encrypt and decrypt messages. Therefore, during the "pairing" or "handshake" process, smart controller 12 generates a unique encryption key and passes this unique encryption key to the remote communicator 22. After the pairing or handshaking process is complete, all communication between smart controller 12 and remote communicator 22 is through bridge transceiver 16. As will be shown in the ensuing description, smart controller 12 may be paired with one or more remote communicators 22. Smart controller 12 and bridge transceiver 16 are programmed with specific software and algorithms to enable the "pairing" or "handshaking" process.

Figure 2:
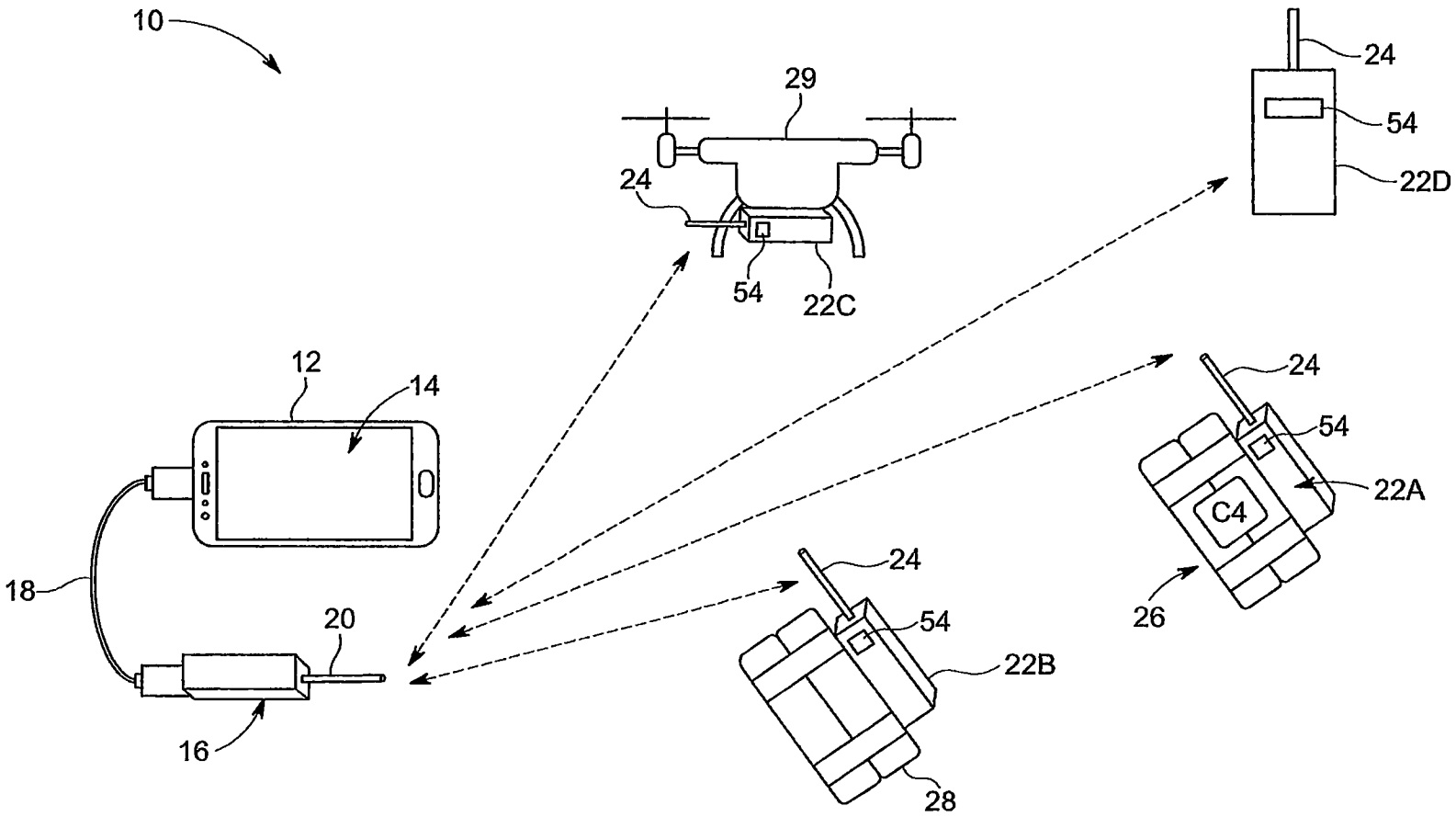
FIG. 2 illustrates communication between a smart controller, bridge transceiver and remote communicators in accordance with an exemplary embodiment.

As will be described in the ensuing description, in some embodiments, remote communicator 22 includes a detonator that, upon receiving a trigger signal, causes detonation of the explosive charge to which remote communicator 22 is connected. Remote communicator 22 further includes electronic circuitry and sensors that sense a variety of parameters including, but not limited to, at least one of motion, noise and vibration levels, temperature, elapsed time, bearing and altitude. Remote communicator 22 transmits encrypted signals representing the sensed parameters back to bridge transceiver 16. In some embodiments, remote communicator 22 includes a camera that provides image data pertaining to the physical environment in which remote communicator 22 is located. Remote communicator 22 includes RF (radio frequency) circuitry for transmitting these signals containing the sensed parameters and/or image data to bridge transceiver 16. Bridge transceiver 16 receives and processes these signals to obtain encrypted digital signals or data packets and routes these digital signals or data packets to smart controller 12. Smart controller 12 decrypts the encrypted digital signals or data packets using the unique encryption key that matches the encryption key stored in the particular remote communicator 22 that sent the message. Smart controller 12 then displays the sensed parameters and/or image data on display 14 of smart controller 12. This aspect of smart controller is further discussed in the ensuing description. Smart controller 12 is configured with one or more algorithms on a collaborative mapping software platform that allows command, control, and monitoring of downrange remote communicators 22. The integration of the operator's ability to use the collaborative mapping software on smart controller 12 to virtually interact with bridge transceiver 16 and remote communicator 22 allows for greater control and real-time monitoring of the remote communicators 22, the corresponding explosive charges and the location or environment in which remote communicator 22 and explosive charge are located. Such real-time monitoring provides the operator with real-time information relating to the status of the remote communicator 22, the location of the explosive charge, the presence of military personnel or non-combatants, and the presence of a desired target. Such real-time monitoring may include other parameters such as at least one of motion, noise and vibration levels, temperature and altitude. Smart controller 12, bridge transceiver 16 and remote communicator 22 are described in detail in the ensuing description. FIG. 2 illustrates an embodiment wherein remote firing system 10 utilizes a network of remote communicators 22, indicated by reference numbers 22A-D. Remote communicator 22A is connected or attached to explosive charge 26. In this scenario, explosive charge 26 is a C4 charge. Remote communicator 22B is connected or attached to explosive charge 28. Remote communicator 22C is mounted to an unmanned aerial vehicle 29. Remote communicator 22D is carried by ground personnel.

Figure 3:
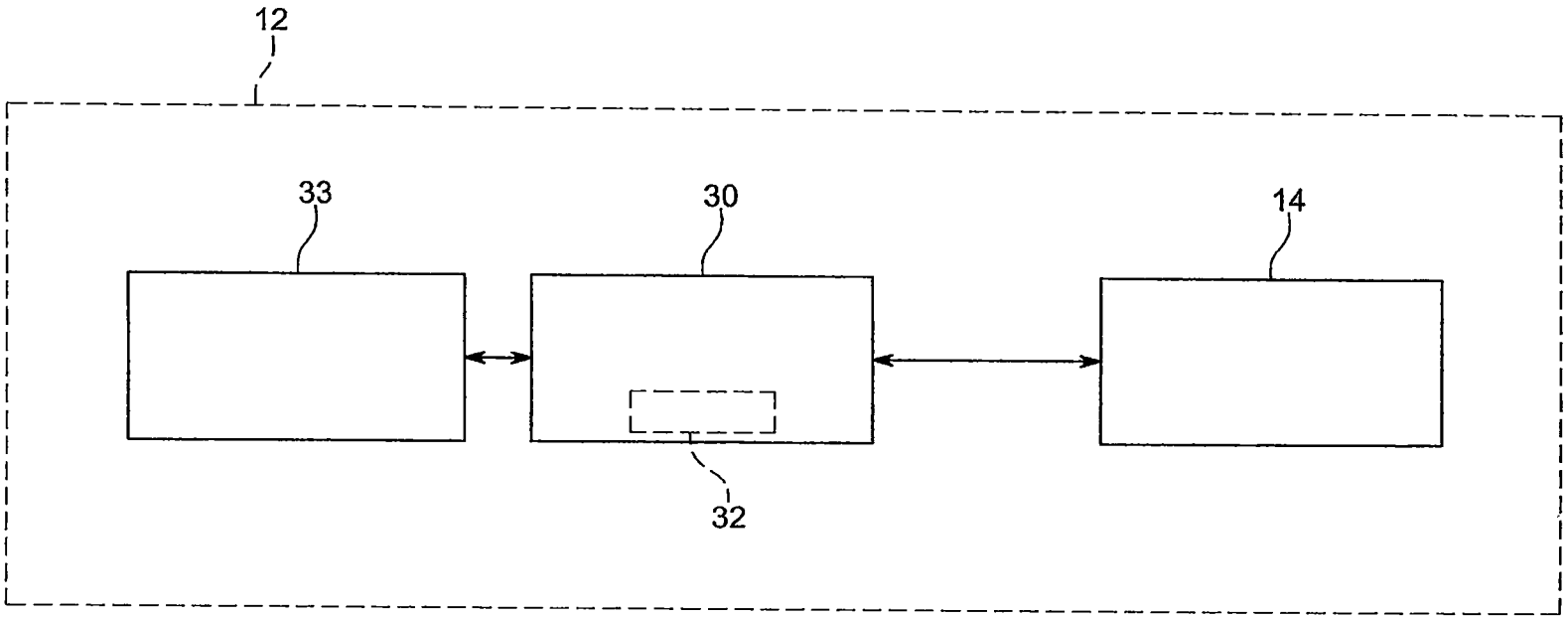
FIG. 3 illustrates an exemplary embodiment of a smart controller.

Referring to FIG. 3, there is shown a block diagram of smart controller 12. Smart controller 12 may be realized by a commercially available smart device. Examples of such a smart device include, but are not limited to, a smart phone (e.g., iPhone), notepad (e.g., iPad) or notebook computer. In an embodiment, smart controller 12 comprises a smart phone. One example of a smart phone is disclosed in U.S. Pat. No. 7,966,578, issued Jun. 21, 2011 and entitled "Portable Multifunction Device, Method, And Graphical User Interface For Translating Displayed Content", the disclosure of which patent is hereby incorporated by reference. Another example of a smart phone is disclosed in U.S. Pat. No. 11,156,463, issued Oct. 26, 2021 and entitled "Mobile Transceiver With Adaptive Monitoring And Reporting", the disclosure of which patent is hereby incorporated by reference. As shown in FIG. 3, smart controller 12 generally comprises touch screen 14 and processor or central processing unit (CPU) 30. Touch screen 14 functions as a user interface in addition to displaying information. Smart controller 12 also includes other circuitry, such as signal processing circuitry, RF (radio-frequency) circuitry and USB input signal circuitry, which are all well known in the smart phone field and therefore are not shown in FIG. 3 or discussed in detail herein. Processor 30 may be realized by either of the processors described in the aforementioned U.S. Pat. Nos. 7,966,578 and 11,156,463. In addition to the software normally programmed into a processor of a smart device, processor 30 is further programmed with a software and firmware application 32 allows mission planning, situational awareness, mission execution and fire solutions. Software and firmware application 32 enables smart controller 12 to communicate command and control signals to bridge transceiver 16 in order to control and derive information from one or more remote communicators 22. In one embodiment, software and firmware application 32 is the ATAK (Android Tactical Assault Kit) software application which is designed for use with any one of variety of networks including cellular, Wi-Fi or mesh network tactical radios. The ATAK software application enables sharing or presentation of voice, text, chat, video, pictures, and an interactive, layered, shared, moving map. The software application's human interface provides team members and friendly forces with an understanding of what is going on around them (i.e., situational awareness. The ATAK software application utilizes all the sensors built into a commercially available smart device including altimeter, compass, barometer and GPS. The ATAK software application provides many functions including, but not limited to, online and offline mapping, collaborative mapping which includes points, drawings and locations of interest, and altitude profiling between locations. Specifically, software and firmware application 32 allows an operator or user of smart controller 12 to implement numerous functions, including:

(i) establishing communication with bridge transceiver 16;

(ii) encrypting digital signals or data packets;

(iii) decrypting received encrypted digital signals or data packets;

(iv) using bridge transceiver 16 to initiate an initial "handshake" between smart controller 12 and a remote communicator 22 so as to pair the remote communicator 22 with smart controller 12;

(v) generating encryption information that is to be transmitted to a remote communicator 22 that is paired with smart controller 12;

(vi) managing the encryption information transmitted to the remote communicator 22 that is paired with smart controller 12;

(vii) allowing the operator or user to use touch screen 14 to select one of a plurality of detonation preconditions during the "pairing" process;

(viii) allowing the operator to use touch screen 14 to program the remote communicator 22 with the selected detonation precondition;

(ix) allowing the operator or user to use touch screen 14 to manage and/or re-program the remote communicators 22 that are paired with smart controller 12;

(x) allowing the operator or user to use touch screen 14 to arm or disarm one or more of the remote communicators 22 that are paired with smart controller 12;

(xi) storing data and information provided by remote communicators 22; and (xii) displaying on touch screen 14 information and data provided by remote communicators 22.

Smart controller 12 further includes memory medium 33. Memory medium 33 may be configured as non-transitory computer readable storage medium, computer system memory or random-access memory, such as DRAM, DDR RAM, SRAM, SDRAM, EDO RAM, Rambus RAM and non-volatile memory. In some embodiments, memory medium 33 includes a read-only-memory (ROM). Memory medium 33 may store program instructions (e.g., ATAK software application) that may be executed by processor 30. Memory medium 33 also stores the plurality of different encryption keys that are used to encrypt messages for the remote communicators 22 that are paired with smart controller 12. When smart controller 12 generates a message intended for a particular remote communicator 22, smart controller 12 encrypts the message with the encryption key corresponding to that particular remote communicator 22. The particular remote communicator 22 has the same encryption key stored in its own memory medium 52 (see FIG. 5A) which allows processor 50 of remote communicator 22 to decrypt the message. Memory medium 33 of smart controller 12 also stores a plurality of different detonation preconditions that determine when remote communicator 22 may detonate an explosive charge that is attached or connected to the remote communicator 22. Examples of detonation preconditions include, but are not limited to, vibration levels, noise levels, temperature, motion of vehicles and/or personnel, GPS coordinates, elapsed time, altitude and/or bearings. For example, if the selected detonation precondition is the "motion of vehicles", then the remote communicator 22 would only generate a detonation signal when the sensors in remote communicator 22 detect or sense vehicle motion.

Figure 4:
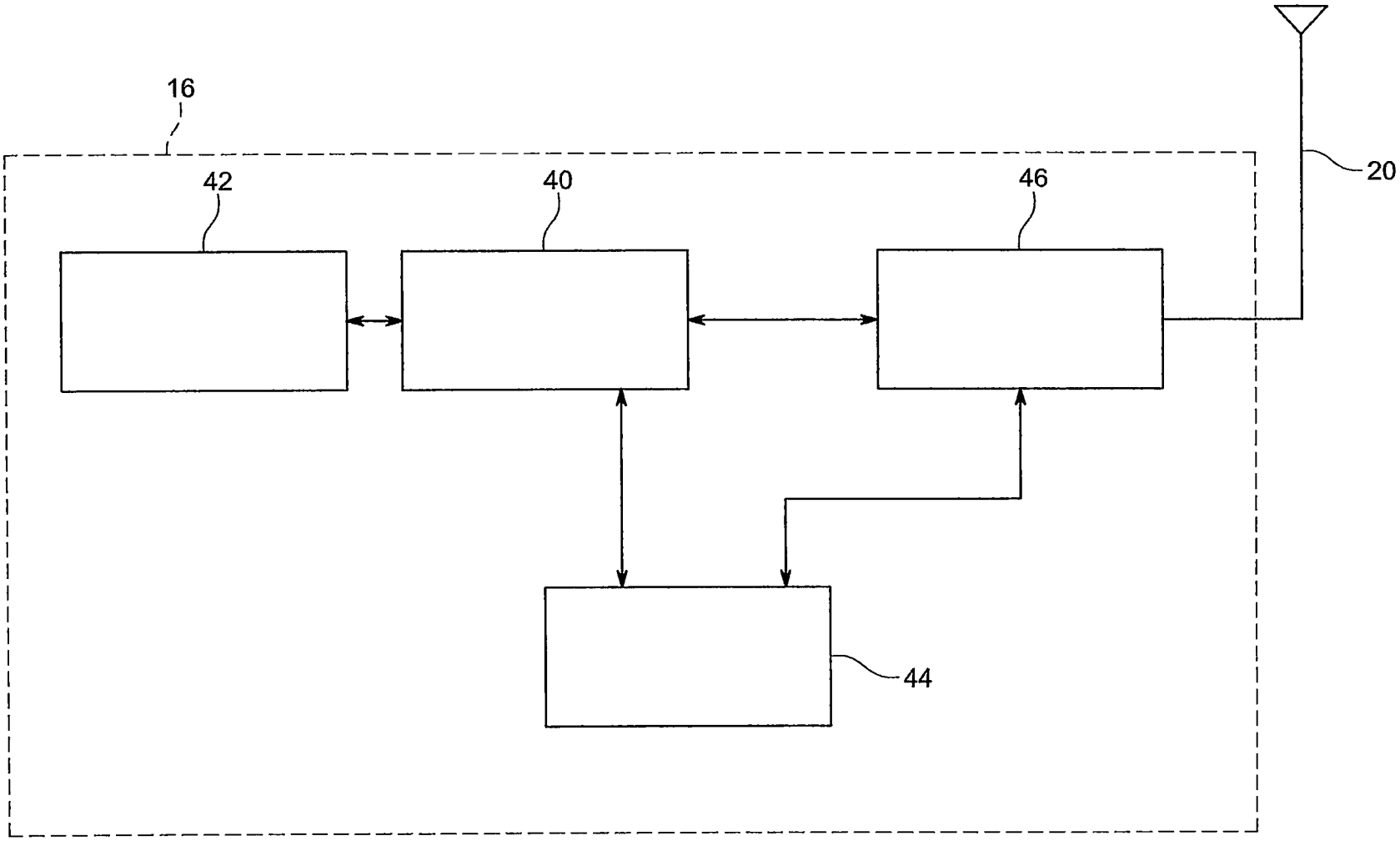
FIG. 4 illustrates an exemplary embodiment of a bridge transceiver.

Referring to FIG. 4, there is shown an exemplary embodiment of bridge transceiver 16. Bridge transceiver 16 generally comprises processor 40 and memory medium 42. Processor 40 is in electronic data communication with memory medium 42. Processor 40 may be configured as an ASIC (Application Specific Integrated Circuit), portions or circuits of individual processor cores, entire processor cores, individual processors, central processing units (CPU), signal processors having analog-to-digital conversion (ADC) circuitry and programmable hardware devices such as field programmable gate array (FPGA). Memory medium 42 may be configured as non-transitory computer readable storage medium, computer system memory or random-access memory, such as DRAM, DDR RAM, SRAM, SDRAM, EDO RAM, Rambus RAM and non-volatile memory such as Flash, magnetic media, hard drive, optical storage, registers or similar types of memory elements. Memory medium 42 may store program instructions (e.g., embodied as computer programs) that may be executed by processor 40. Bridge transceiver 16 further includes input/output circuitry 44 that includes a USB (Universal Serial Bus) port that is adapted for connection to USB cable 18 (see FIG. 1). Input/output circuitry 44 receives the encrypted digital signals or data packets generated by smart controller 12. The encrypted digital signals or data packets contain the command-and-control messages or instructions. Input/output circuitry 44 may include memory medium such as cache memory for temporarily storing the encrypted digital signals or data packets. Processor 40 generates a control signal that prompts input/output circuitry 44 to send the encrypted digital signals or data packets to RF circuitry 44. RF circuitry 44 is configured to modulate a radio frequency carrier signal with the encrypted digital signals or data packet to produce a modulated signal. Various techniques known in the art may be used to modulate the RF carrier signal with the encrypted digital signals or data packets and therefore, this aspect of RF circuitry 44 is not discussed in detail. RF circuitry 44 couples the modulated signal to antenna 20 which radiates the modulated signal so that it will be received by remote communicators 22. As will be described in the ensuing description, remote communicators 22 receive and demodulate the RF signals radiated from antenna 20. If the remote communicator 22 has the encryption key needed to decrypt the encrypted message, the remote communicator 22 will successfully decrypt the encrypted message to obtain the command-and-control messages or instructions (e.g., arm, disarm, detonate, provide status, etc.). If remote communicator 22 does not have the correct encryption key, then the remote communicator 22 will not be able to correctly decrypt the encrypted message since the remote communicator 22 is not the intended recipient. If the remote communicator 22 is not the intended recipient, then it will not be possible for that remote communicator 22 to implement any of the command-and-control instructions.

RF circuitry 46 includes additional circuitry to enable communication via any one of various wireless modes of communication including, but not limited to, at least one of Internet of Things (IoT) radio communication, satellite, Wi-Fi, Bluetooth, Bluetooth Low Energy (BLE), short-range line-of-sight (LOS) communication and long-range communication via cellular network. In scenarios where remote communicators 22 are physically close to the operator/user and smart controller 12, bridge transceiver 16 may communicate via an IoT RF network or a short-range communication scheme such as Wi-Fi, Bluetooth and Bluetooth Low Energy (BLE). Bridge transceiver 16 automatically switches to a long-range communication scheme for communication with a remote communicator 22 if it is not possible to use short-range communication schemes. Examples of long-range communication schemes are satellite communication and cellular network communication. Short-range communication schemes may not be possible if there is jamming, or if any of remote communicators 22 are located indoors. Line-of-sight (LOS) communication would not possible if a remote communicator 22 is not in the line-of-sight (LOS). RF circuitry 46 is also configured to demodulate signals received from remote communicators 22 so as to extract encrypted data packets generated by the remote communicators 22. The encrypted data packet extracted from the signal sent by the remote communicator 22 contains status information regarding the remote communicator 22, the corresponding explosive charge and/or the location in which remote communicator 22 and explosive charge are located. Processor 40 prompts RF circuitry 46 to route the encrypted data packet to input/output circuitry 44. Processor 40 then prompts input/output circuitry 44 to send the encrypted data packet to smart controller 12. Processor 30 of smart controller 12 decrypts the encrypted data packet, with the appropriate encryption key, in order to extract the status information provided by remote communicator 22. The status information is then displayed on touch screen 14 of smart controller 12.

Figure 5A:
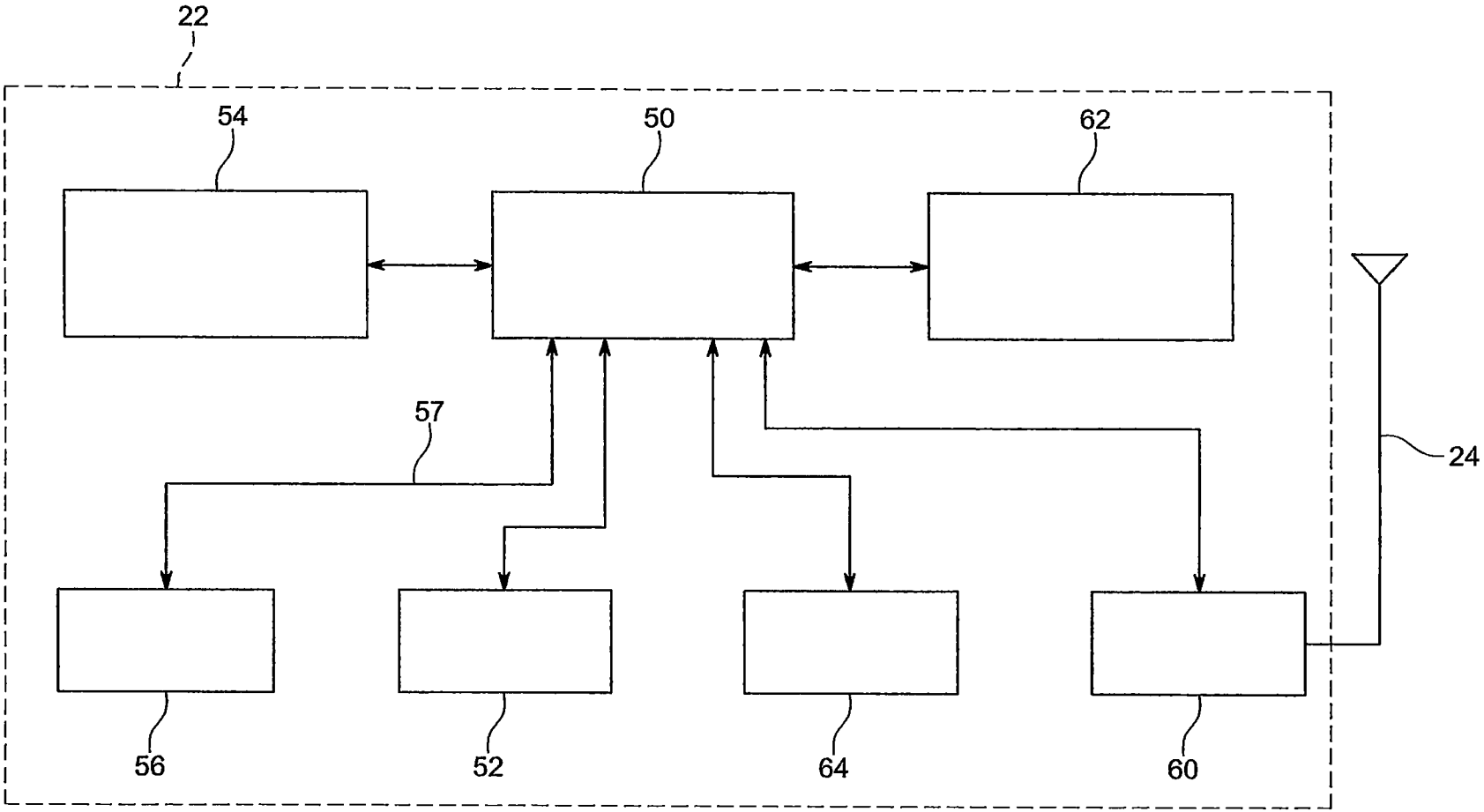
FIG. 5A illustrates an exemplary embodiment of a remote communicator.

FIG. 5A illustrates an exemplary embodiment of a remote communicator 22. Remote communicator 22 comprises processor 50, memory medium 52 and display 54. Processor 50 is in data signal communication with memory medium 52 and display 54. Processor 50 may be configured as an ASIC (Application Specific Integrated Circuit), portions or circuits of individual processor cores, entire processor cores, individual processors, central processing units (CPU), signal processors having analog-to-digital conversion (ADC) circuitry and programmable hardware devices such as field programmable gate array (FPGA). Memory medium 52 may be configured as non-transitory computer readable storage mediums, computer system memory or random-access memory, such as DRAM, DDR RAM, SRAM, SDRAM, EDO RAM, Rambus RAM and non-volatile memory such as Flash, magnetic media, hard drive, optical storage, registers or similar types of memory elements. Processor 50 is programmed with one or more software applications that implement numerous functions including decryption and encryption of messages. Memory medium 52 may store program instructions (e.g., embodied as computer programs) that may be executed by processor 50. Memory medium 52 also stores the unique encryption key needed by the remote communicator 22 to decrypt messages that were encrypted with the same encryption key. Display 54 may be an LCD (liquid crystal display) or LED (light-emitting diode) display that displays device status information provided by processor 50. In one embodiment, shown in FIG. 5A, remote communicator 22 further comprises detonator 56 that is in communication with processor 50. When the detonation precondition is fulfilled, processor 50 generates a trigger signal 57 that is coupled to detonator 56. Upon receipt of trigger signal 57, detonator 56 detonates the explosive charge (see FIG. 1) that is connected to remote communicator 22.

Remote communicator 22 further comprises RF circuitry 60 that is coupled to antenna 24. RF circuitry 60 is configured to implement any one of a variety of modes of communication including, but not limited to, at least one of Internet of Things (IoT) radio communication, satellite communication, Wi-Fi, Bluetooth, Bluetooth Low Energy (BLE), short-range line-of-sight (LOS) communication and long-range communication via cellular network. Antenna 24 receives the RF signals or signal bursts from bridge transceiver 16 and couples these signals to RF circuitry 60. RF circuitry 60 includes demodulation circuitry that demodulates the received RF signals to extract the original encrypted data packet. RF circuitry 60 routes the encrypted data packet to processor 50 which decrypts the data packet using the unique encryption key in order to extract the command-and-control information originally sent by the operator/user of smart controller 12. The command-and-control information instructs remote communicator 22 to take certain actions such as acknowledging and accepting "handshaking" signals so as to become paired with smart controller 12. The command-and-control information may instruct remote communicator 22 to update or change the detonation precondition. The command-and-control information may arm or disarm remote communicator 22. If remote communicator 22 is armed, processor 50 will generate trigger signal 57 when the detonation preconditions are fulfilled. If remote communicator 22 is to be disarmed, processor 50 will not issue trigger signal 57 under any conditions. The command-and-control information may also request the remote communicator 22 to provide real-time status information pertaining to the location of the remote communicator 22 and the corresponding explosive charge. The real-time status information is provided by camera 62 and sensor circuitry 64 that are discussed in the ensuing description.

Remote communicator 22 includes sensor circuitry 64 that is in signal communication with processor 50 and which is responsible for generating real-time status information pertaining to the physical location in which the remote communicator 22 and corresponding explosive charged are located. The real-time status information provides the "situational awareness" needed by the operator/user of smart controller 12. Sensor circuitry 64 comprises a plurality of sensors, either in the form of discrete components or individual sensor devices, that sense or detect a variety of physical and environmental properties or parameters such as temperature, vibrations, motion, noise, altitude and bearing. Sensor circuitry 64 outputs digital signals representing the sensed properties or parameters. These digital signals are inputted into processor 50 which encrypts the digital signals with the unique encryption key to generate encrypted digital signals or data packets. The encrypted data packets are then routed to RF circuitry 60 and used to modulate the RF carrier signal so as to generate a modulated RF signal. The modulated RF signal is coupled to antenna 24 which radiates the signal so that it is received by bridge transceiver 16. Bridge transceiver 16 demodulates the received modulated RF signal so as to extract the encrypted data packet. The encrypted data packet is sent over USB cable 18 to smart controller 12 wherein processor 30 decrypts the encrypted data packet using the matching unique encryption key to extract the real-time status information. Processor 30 then routes the real-time status information to touch screen 14 which displays the real-time status information for viewing by the operator/user. The "situational awareness" provided by this real-time status information enables the operator/user to achieve the mission goal or, if necessary, to abort any detonation of the explosive charge due to safety issues or other change in circumstances.

In some exemplary embodiments, remote communicator 22 includes camera 62. In such embodiments, camera 62 generates video information pertaining to the location in which remote communicator 22 is located. Camera 62 provides video signals to processor 50. Processor 50 is programmed with one or more video compression algorithms which compress the video signals. Examples of video compression algorithms include H.264/AVC or H.265/HEVC. The compressed video signals are provided to RF circuitry 62. RF circuitry 62 includes video modulation circuitry that modulates the RF carrier signal with the compressed video signals. RF circuitry 62 then couples the video modulated RF signal to antenna 24 which then radiates the signal so that it is received by bridge transceiver 16. Bridge transceiver 16 receives the video modulated RF signals which are then demodulated by RF circuitry 46 so as to provide compressed video signals. Processor 40 then routes the compressed video to input/output circuitry 44 so that the compressed video may be routed to smart controller 12 over USB cable 18. Processor 30 of smart controller 12 decompresses the compressed video and then routes the uncompressed video to touch screen 14 wherein it is displayed. The operator now has a view of the area surrounding remote communicator 22 and corresponding explosive charge. The video signals may indicate the lack of a target, the presence of friendly forces or non-combatants, or the presence of hostile forces, or activity in the area that cannot be explained or ascertained.

Figure 5B:
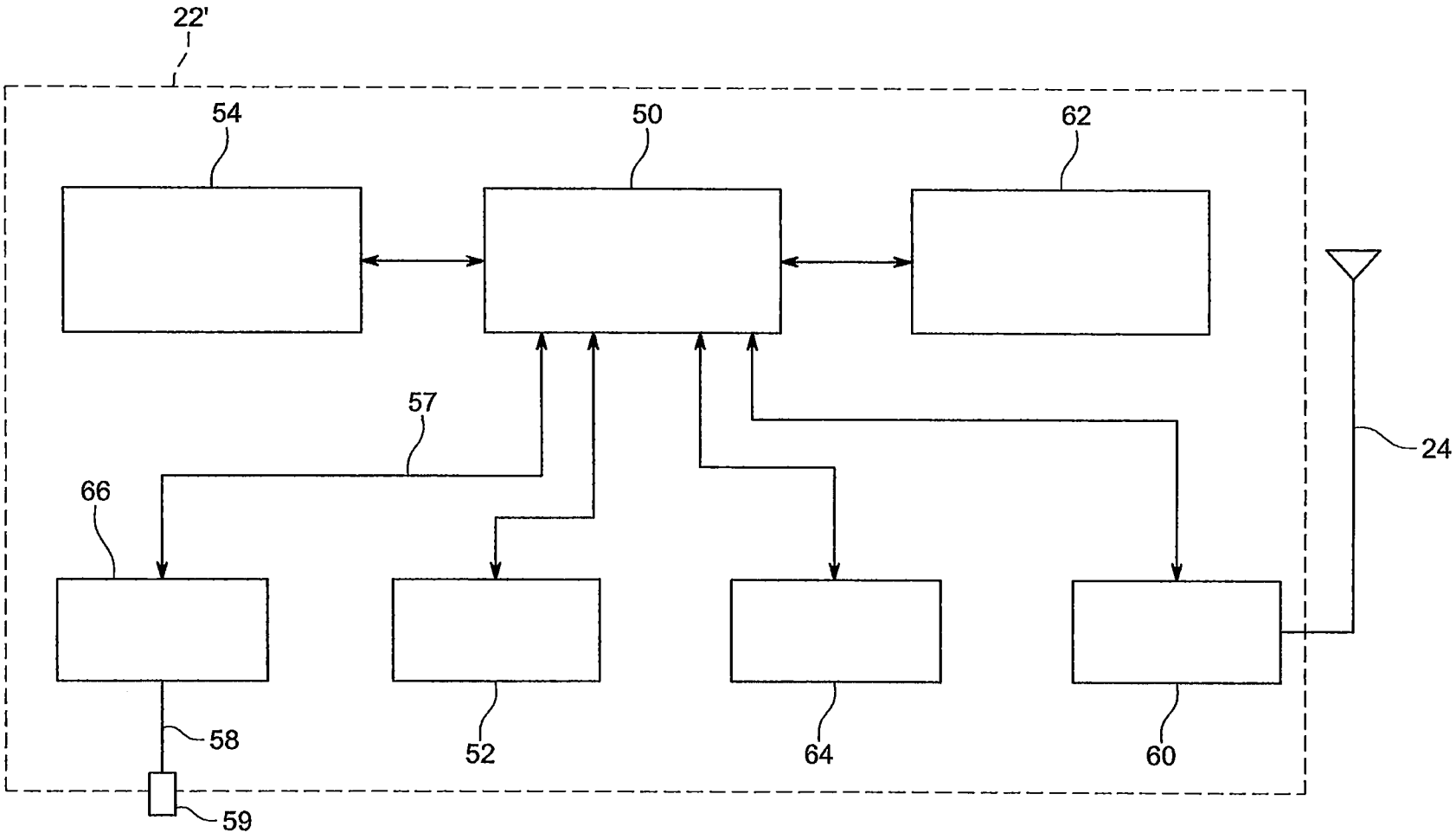
FIG. 5B illustrates another exemplary embodiment of a remote communicator.

FIG. 5B shows remote communicator 22' which is another embodiment of remote communicator 22. Remote communicator 22' comprises initiator circuitry 66 that is in signal communication with processor 50. When detonation preconditions are fulfilled, processor 50 generates a trigger signal 57. Trigger signal 57 is coupled to initiator circuitry 66. In response, initiator circuitry 66 outputs detonation signal 58 to electrical connector 59. An explosive charge (see FIG. 1) is connected to electrical connector 59. Upon receiving detonation signal 58, the explosive charge detonates.

Figure 6:
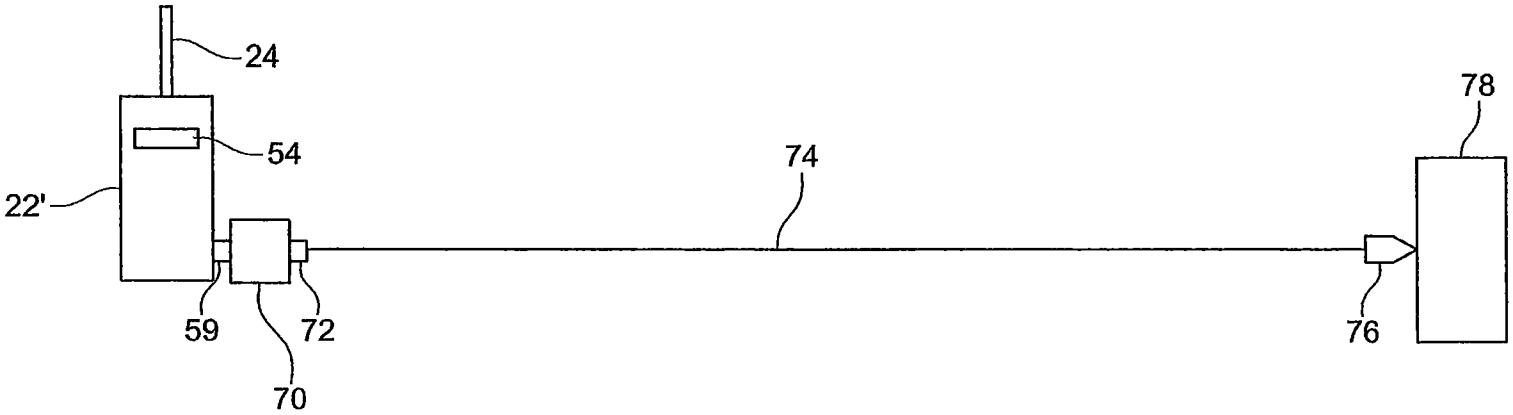
FIG. 6 illustrates a configuration in accordance with an exemplary embodiment wherein a modular initiator device is connected to a remote communicator and a cable is connected between the modular initiator device and an explosive charge.

FIG. 6 illustrates an embodiment wherein remote communicator 22' is not destroyed upon detonation of the explosive charge and may be used repeatedly. Modular initiator device 70 is electrically connected to electrical connector 59 and receives detonation signal 58. Modular initiator device 70 may be configured as any one of a variety of initiators including, but not limited to, EBW, LEFI, low-voltage and non-electric. Modular initiator device 70 includes internal circuitry and output connector 72. Cable or wire 74 is connected to connector 72 and to detonator 76. Detonator 76 is attached or connected to explosive charge 78. In some embodiments, detonator 76 is a blasting cap or similar energetic. Explosive charge 78 may be a C4 charge. Cable or wire 74 has a sufficient length to allow safe positioning of remote communicator 22' so that it is not damaged upon detonation of explosive charge 78. In this configuration, detonation signal 58 is inputted into modular initiator device 70 which, in response, outputs a secondary signal over cable or wire 74 that excites detonator 76 thereby causing detonation of explosive charge 78. Since remote communicator 22' and modular initiator device 70 are located at a safe distance from explosive charge 78, they are not destroyed in the explosion and therefore may be reused.

In another embodiment, remote communicator 22' has a plurality of electrical connectors that perform the same function as electrical connector 59. A separate cable, similar to cable 74, is attached to a corresponding one of these electrical connectors. A modular detonator is electrically connected to the opposite end of each of these cables and to a corresponding explosive charge. Signal 58 travels over all of the cables to the corresponding modular detonators. Upon receipt of signal 58, modular detonators detonate all of the explosive charges simultaneously. In some embodiments, the circuitry of the modular detonators is configured to create detonations in a sequential order so as to achieve a detonation train. For example, the modular detonators may detonate the explosive charges in intervals of five (5) seconds.

Figure 7:
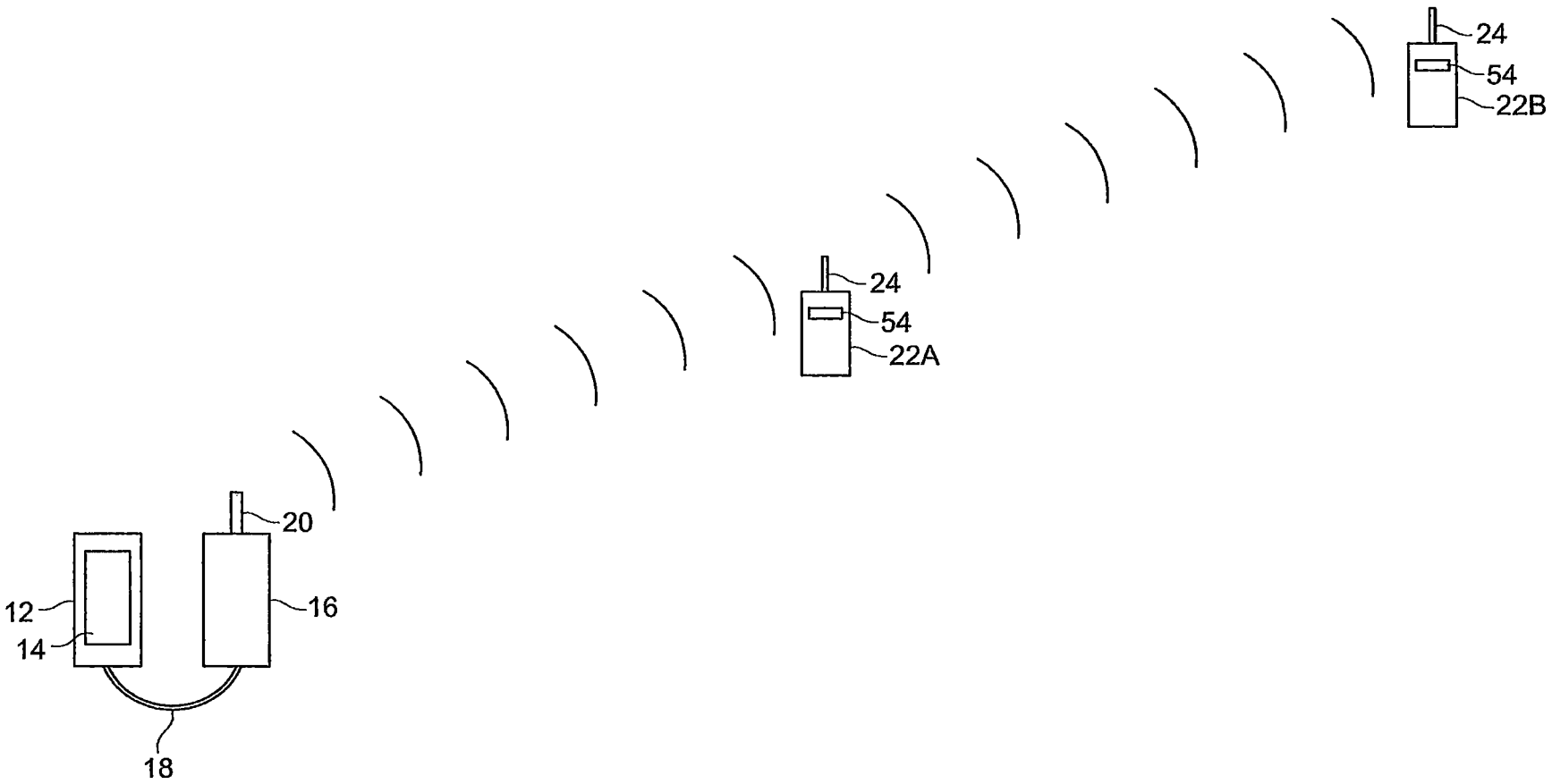
FIG. 7 illustrates a first remote communicator that receives a signal from a bridge transceiver and then relays the signal to a second remote communicator in accordance with an exemplary embodiment.

Referring to FIG. 7, remote communicator device 22 may be used to relay signals to another remote communicator 22 that is out signal range and cannot receive signals from bridge transceiver 16. In this scenario, bridge transceiver 16 is using the line-of-sight (LOS) communication. Remote communicator 22A is within range of bridge transceiver 16 but remote communicator 22B is out of range. However, remote communicator 22B is within range of the transmissions made by remote communicator 22A. Remote communicator 22A is located at a remote location and may be carried by ground personnel or it may be attached or connected to an explosive charge. The operator/user wishes to send command-and-control instructions to remote communicator 22B. In this case, bridge transceiver 16 transmits an initial first RF signal burst to remote communicator 22A and then after a predetermined amount of time, transmits a second RF signal burst. The time between the first and second RF signal bursts may vary but would be in a range of 5-10 seconds. RF circuitry 60 demodulates the initial first RF signal burst to extract an encrypted data packet that is routed to processor 50. Processor 50 uses the unique encryption key to decrypt the encrypted data packet. The decrypted data packet includes a command to re-transmit a second RF signal burst that will follow. RF circuitry 60 includes a RF delay circuit or component that delays the second RF signal burst from being re-transmitted until the entire second RF signal burst has been received by remote communicator 22A. Once the entire second RF signal burst has been received, RF circuitry 60 automatically amplifies the second RF burst to compensate for any attenuation in amplitude and then re-transmits the second RF burst signal. Remote communicator 22B receives the re-transmission of the second RF signal burst and demodulates the signal to extract the encrypted data packet. Processor 50 of remote communicator 22B uses its unique encryption key to decrypt the encrypted data packet to obtain the commands, instructions and/or requests originally demanded by the operator/user of smart controller 12. Remote communicator 22B then implements the commands, instructions and/or requests.

Figure 8:
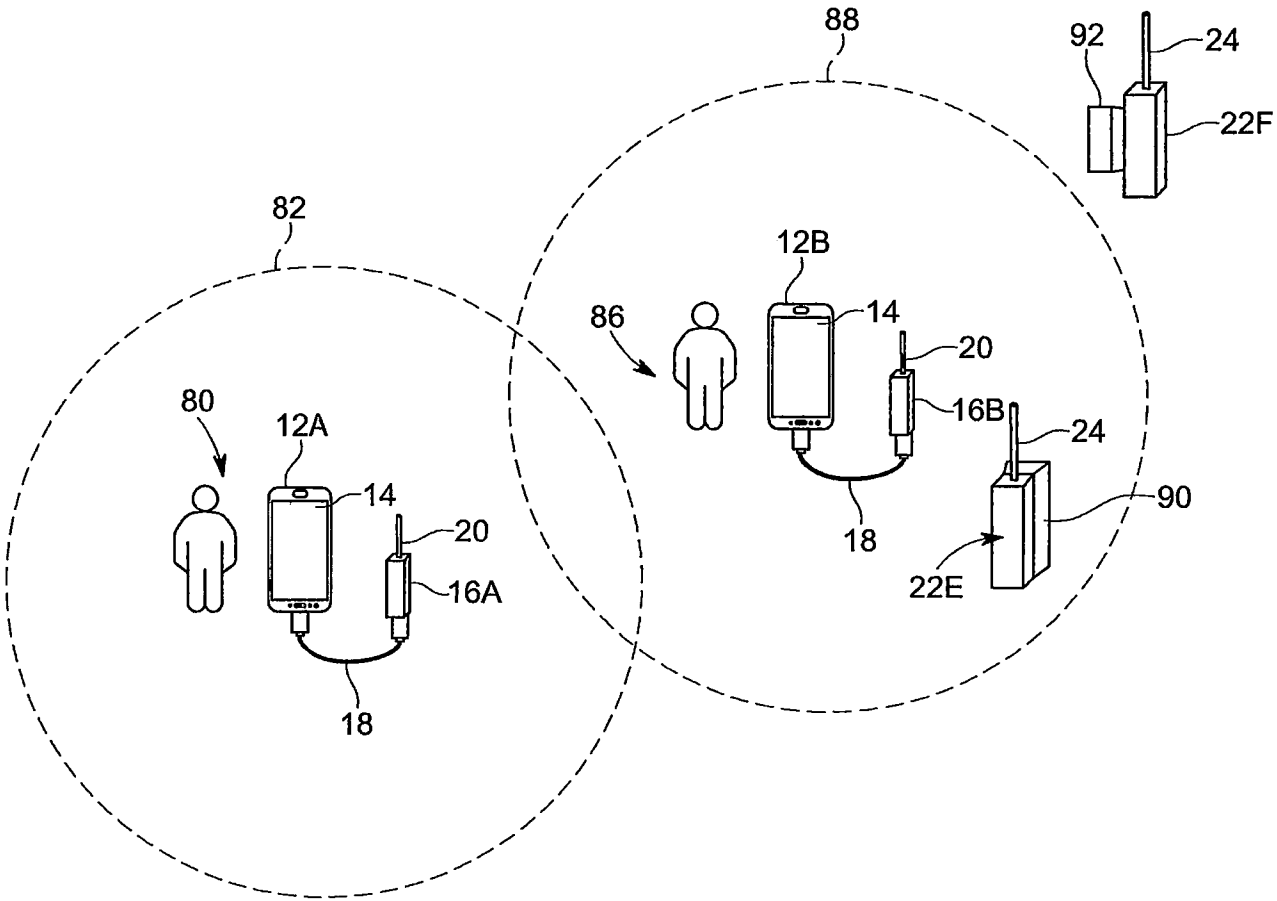
FIG. 8 illustrates operation of a remote firing system in accordance with an exemplary embodiment.

Referring to FIG. 8, there is shown one example of the operation of remote firing system 10. FIG. 8 shows a pair of smart controllers 12 that are indicated by the reference numbers 12A and 12B, and a pair of bridge transceivers 16 that are indicated by reference numbers 16A and 16B. Operator 80, smart controller 12A and bridge transceiver 16A are located within a specific geographical area defined by perimeter 82. Operator 86, smart controller 12B and bridge transceiver 16B are located within a specific geographical area defined by perimeter 88. Remote communicator 22E is also located within perimeter 88 and is attached or connected to an explosive charge 90. The GPS coordinates of operator 86, the locations of remote communicators 22E and 22F and various points on perimeter 88 are inputted into smart controllers 12A and 12B. Remote communicator 22F is located outside of perimeter 88 and is mounted or attached to explosive charge 92. The locations of operators 80 and 86 and locations of remote communicators 22E and 22F are known and shared among smart controllers 12A and 12B. Since remote communicator 22E and explosive charge 90 are located within perimeter 88, smart controllers 12A and 12B are programmed to automatically block the arming of remote communicator 22E so as to provide a safe environment for operator 86 and any friendly forces and/or non-combatants within perimeter 88. Alternatively, smart controllers 12A and 12B may compute the distance between operator 86 and remote communicator 22E. If the computed distance is less than a predetermined user-specified distance, smart controllers 12A and 12B will automatically block arming of remote communicator 22E. However, remote communicator 22F and corresponding explosive charge 92 are located outside of perimeter 88 and beyond the predetermined user-specified distance. Therefore, smart controllers 12A and 12B enable arming of remote communicator 22F.

Figure 9:
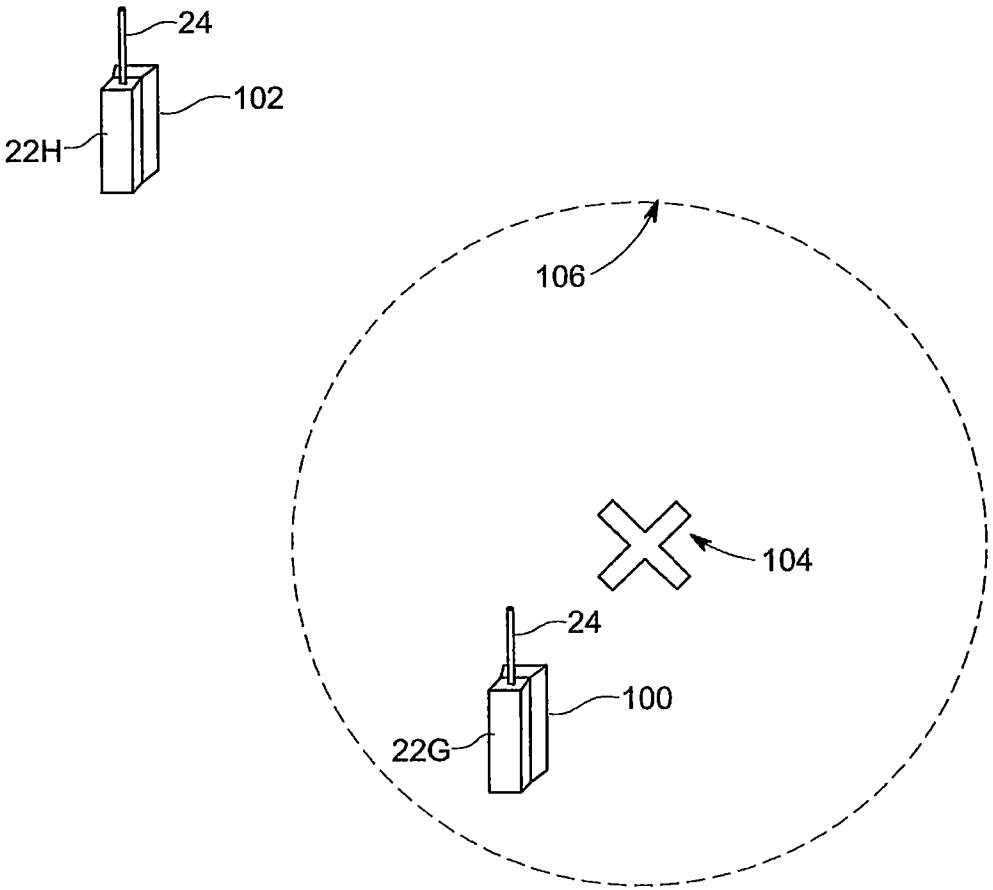
FIG. 9 illustrate operation of a remote firing system in accordance with an exemplary embodiment.
Figure 9:
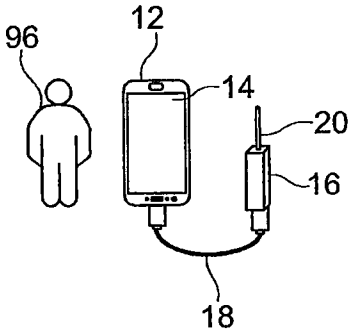

The ability to arm, fire, and perform other safety-critical operations may also depend on a remote communicator's location in relation to a target of interest. For example, as shown in FIG. 9, remote communicators 22G and 22H are each connected to a corresponding explosive charge 100 and 102, respectively. Target 104 is located at about the center of a geographical area that is defined by perimeter 106. Remote device 22G and explosive charge 100 are located within perimeter 106. However, remote communicator 22H and explosive charge 102 are located outside of perimeter 106 such that target 104 is out of the range of remote communicator 22H. In such a scenario, operator 96 uses smart controller 12 to arm remote communicator 22G and disarm remote communicator 22H.

During Explosive Ordnance Disposal (EOD) operations, the capability of camera 62 (see FIG. 5) to provide visual information to smart controller 12 allows an operator/user to clearly view the location of the explosive charges and quickly determine whether any team members are in proximity to the explosive charges. This visual information provides the operator/user with significantly greater situational awareness which is critical in deciding whether to initiate detonation of the explosive charges. Upon learning that team members or non-combatants are in proximity to the explosive charges, the operator/user operates smart controller 12 to halt detonation of the explosive charges. Once the visual information provided by remote communicators 22 indicates team members or non-combatants are no longer in proximity to the explosive charges, the operator/user operates smart controller 12 to initiate detonation of the explosive charge.

Remote firing system 10 provides many benefits and advantages. For example, the multi-mode communication capabilities of bridge transceiver 16 and programmable remote communicators 22 allow communication in environments where long-range RF communication or GPS-based communications are not possible. Remote firing system 10 allows command and control of a significantly larger number of remote communicators 22 in comparison to conventional firing systems. Remote firing system 10 integrates the algorithms of smart controller 12 and bridge transceiver 16 to track remote communicators 22, receive feedback information from remote communicators 22 and display such feedback information to the operator. These capabilities allow the operator to halt detonation, disarm remote communicator 22, change detonation preconditions, and then re-arm remote communicator 22 in accordance with new detonation preconditions. The encryption scheme and unique encryption keys utilized by remote firing system 10 provides secure communication to all devices while minimizing the size of the data packets thereby allowing for higher connection reliability. Proprioceptive and exteroceptive sensor circuitry in remote communicators 22 provide the operators/users with the ability to dynamically program detonation preconditions or criteria during the process of pairing smart controller 12 with a remote communicator 22 and also change detonation preconditions after remote communicator 22 has been deployed.

In alternate embodiments, the remote firing system of the present disclosure utilizes inert remote communicators that are programmed with the same encryption and message schema as smart controller 12 and function as inert receivers. Such inert receivers may be configured as any type of sensor to provide situational awareness. Examples of such inert receivers include global navigation satellite system (GNSS) tracker, cameras with image recognition and mechanical actuators for interacting with other devices.

Remote firing system 10 may be used in with an unmanned aerial system (UAS) such as a drone. In such a configuration, an explosive charge (e.g., C4 charge) is attached or mounted to the drone and a remote communicator 22 is connected or attached to the explosive charge. Smart controller 12 is paired with the remote communicator 22 thereby enabling the operator to use smart controller 12 to program a detonation precondition into remote communicator 22 and then subsequently arm the remote communicator 22. In this scenario, the detonation precondition may be GPS coordinates, altitude, bearings or the presence of a specific target in a designated location. Camera 62 on remote communicator 22 provides imagery of the impact area or location where a target is expected. The aforementioned imagery and specific detonation precondition ensure remote communicator 22 will detonate the explosive charge only on the specific target. In the event of an operational failure of the UAS, smart controller 12 is programmed to automatically generate a deactivation signal that disarms or deactivates remote communicator 22 in order to prevent detonation of the explosive charge. Alternatively, remote firing system 10 may be used as a flight termination system (FTS) in the event of an operational failure of the UAS.

The remote firing system of the present disclosure may also be used with an unmanned underwater vehicle (UUV). In this configuration, the explosive charge and remote communicator 22 are on board the UUV and remote communicator 22 includes a sensor that senses water pressure. Remote communicator 22 is also configured with waterproofing material to prevent water damage. The operator uses smart controller 12 to program processor 50 of remote communicator 22 with a predetermined water pressure. The predetermined water pressure corresponds to a desired depth at which detonation of the explosive charge shall occur. As the UUV descends, the water pressure increases. When the water pressure equals the predetermined water pressure, the desired depth has been reached and remote communicator 22 detonates the explosive charge on aboard the UUV.

The remote firing system of the present disclosure may also be used with an unmanned surface vehicle (USV) that is laden with one or more explosive charges and tasked to travel over-the-horizon to a distant target. A remote communicator 22 is mounted to the USV. In this configuration, an operator uses smart controller 12 to program remote communicator 22 via satellite constellation. The remote communicator 22 that is mounted to the USV provides status information to smart controller 12 so as to inform the operator when it is time to detonate the explosive charges.

The foregoing description of illustrated exemplary embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. In this regard, while the disclosed subject matter has been described in connection with various embodiments and corresponding Figures, where applicable, it is to be understood that other similar embodiments can be used or modifications and additions can be made to the described embodiments for performing the same, similar, alternative or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A remote firing system for remotely detonating an explosive charge, comprising:

a bridge transceiver comprising a first memory medium and a first processor;

a smart controller comprising a user interface, a second memory medium and a second programmable processor in communication with the user interface, wherein the second programmable processor is in communication with the second memory medium, wherein the smart controller is configured to generate encrypted command-and-control signals that include a detonation precondition that must be fulfilled before detonation of the explosive charge, wherein the bridge transceiver in communication with the smart controller, wherein the bridge transceiver comprises the first memory medium and the first processor in communication with the first memory medium, and wherein the bridge transceiver is configured to receive the encrypted command-can-control signals from the smart controller and transmit radio frequency (RF) signals containing the encrypted command-and-control signals; and at least one remote communicator being in signal communication with the bridge transceiver and being configured for connection to the explosive charge, wherein said at least one remote communicator includes a third memory medium and a third programmable processor in communication with the third memory medium of the at least one remote communicator, wherein said at least one remote communicator is configured to receive the RF signals transmitted by the bridge transceiver, process the received RF signals to extract the encrypted command-and-control signals, and decrypt the encrypted command-and-control signals to extract the detonation precondition, wherein the third programmable processor of the at least one remote communicator is configured to generate a trigger signal that causes the detonation of the explosive charge when the detonation precondition has been fulfilled, wherein the at least one remote communicator further comprises a camera in communication with the third programmable processor of the at least one remote communicator, and wherein the camera is configured to provide images of an environment in which the at least one remote communicator is located.

2. The remote firing system according to claim 1, wherein the third programmable processor of the at least one remote communicator is configured to encrypt the images to produce encrypted image signals.

3. The remote firing system according to claim 1, wherein the third programmable processor of the at least one remote communicator is configured to encrypt the images to produce encrypted image signals, and wherein the at least one remote communicator is configured to transmit RF signals containing the encrypted image signals.

4. A remote firing system, comprising:

a bridge transceiver comprising a first memory medium and a first processor;

a smart controller comprising a user interface, a second memory medium and a second programmable processor in communication with the user interface, wherein the second programmable processor is in communication with the second memory medium, wherein the second memory medium is configured to store a plurality of different encryption keys and the second programmable processor is configured to encrypt command-and-control messages with any of the encryption keys, and wherein the command-and-control messages include a detonation precondition that must be fulfilled before detonation of explosive charges;

wherein the bridge transceiver is in communication with the smart controller, wherein the bridge transceiver comprises the first memory medium and the first processor in communication with the first memory medium, and wherein the bridge transceiver is configured to receive encrypted command-and-control messages from the smart controller and transmit radio frequency (RF) signals containing the encrypted command-and-control messages; and a plurality of remote communicators being in signal communication with the bridge transceiver, wherein each of said plurality of remote communicators is configured for connection to a corresponding one of the explosive charges, wherein each of said plurality of remote communicators comprises a third memory medium and a third programmable processor in data communication with the third memory medium, wherein each of said plurality of remote communicators includes one of the plurality of different encryption keys stored in respective the third memory medium of each of the plurality of remote communicators, wherein said each of said plurality of remote communicators is configured to receive the RF signals transmitted by the bridge transceiver, process the received RF signals to extract the encrypted command-and-control messages and decrypt the encrypted command-and-control messages using the one of the plurality of different encryption keys stored in the memory medium of the remote communicator so as to extract the detonation precondition, wherein the third programmable processor of said each of the plurality of remote communicator is further configured to generate a trigger signal upon fulfillment of the detonation precondition, wherein said each of the plurality of remote communicators further comprises a detonator circuit configured to receive the trigger signal and in response, detonate the corresponding one of the explosive charges, wherein said each of the plurality of remote communicators further comprises a camera in communication with the third programmable processor of said each of the plurality of remote communicators, and wherein the camera is configured to provide images of an environment in which said each of the plurality of remote communicators is located.

5. The remote firing system according to claim 4, wherein the third programmable processor of the each of the plurality of remote communicators is configured to encrypt the images to produce encrypted image signals.

6. The remote firing system according to claim 4, wherein the third programmable processor of the each of the plurality of remote communicators is configured to encrypt the images to produce encrypted image signals, and wherein each of the plurality of remote communicators is configured to transmit RF signals containing the encrypted image signals.

* * * * *